United States Patent [19]

Kogame et al.

[11] Patent Number: 4,515,854

[45] Date of Patent: May 7, 1985

[54] ENTANGLED FIBROUS MAT HAVING GOOD ELASTICITY AND METHODS FOR THE PRODUCTION THEREOF

[75] Inventors: Kunio Kogame; Yoshihiro Tanba; Masaru Makimura, all of Kurashiki, Japan

[73] Assignee: Kuraray Co., Ltd., Kurashiki, Japan

[21] Appl. No.: 605,642

[22] Filed: Apr. 30, 1984

[30] Foreign Application Priority Data

May 13, 1983 [JP] Japan ..... 58-84481
May 13, 1983 [JP] Japan ..... 58-84482

[51] Int. Cl.[3] ..... D04H 1/58

[52] U.S. Cl. ..... 428/288; 28/103; 28/107; 28/112; 428/299; 428/300; 428/301; 428/904; 428/222

[58] Field of Search ..... 428/904, 299, 300, 301, 428/302, 288, 217, 222; 28/103, 112, 107

[56] References Cited

U.S. PATENT DOCUMENTS

| | | | |
|---|---|---|---|
| 2,336,797 | 12/1943 | Maxwell | 28/103 |
| 3,272,898 | 9/1966 | Knee | 28/103 |
| 4,107,364 | 8/1978 | Sisson | 428/296 |
| 4,198,459 | 4/1980 | Brumlik | 28/220 |
| 4,209,563 | 6/1980 | Sisson | 428/296 |
| 4,438,172 | 3/1984 | Katsutoshi et al. | 428/300 |

*Primary Examiner*—James J. Bell
*Attorney, Agent, or Firm*—Kramer and Brufsky

[57] ABSTRACT

An entangled fibrous mat comprising an elastic polymer fiber A and a nonelastic polymer fiber B, said fiber A having voids therein and being in a taut condition within the mat; while said fiber B is in a slack condition and is highly elastic and flexible, rich in fullness, and firm-bodied, thus being very suitable for use as a substrate for artificial leather.

13 Claims, 2 Drawing Figures

ENTANGLED FIBROUS MAT HAVING GOOD ELASTICITY AND METHODS FOR THE PRODUCTION THEREOF

BACKGROUND OF THE INVENTION

1. Field of the Invention

This invention relates to a fibrous mat having good elasticity. More particularly, it relates to a fibrous mat which is substantially resistant to structural deformation upon repeated elongation, thus excellent in elasticity and fiber entanglement, highly flexible, rich in fullness, and firm-bodied, hence suited for use as a substrate for leather-like sheet materials.

2. Description of the Prior Art

Highly elastic fibrous mats have heretofore been prepared, for instance, by depositing short polyurethane fibers prepared by flush spinning (a method of producing fibers by taking advantage of the phenomenon of roping upon blowing off a molten polymer with high-speed air), followed by adhesion at the points of contact by self-agglutination or some other appropriate method, or by producing a polyurethane long fiber mat by the spun bond technique, such as disclosed in Japanese patent application Kokai No. Sho-52-81,177. With these polyurethane mats, however, it is difficult to attain a sufficient degree of fiber entanglement by conventional methods such as needle punching or entanglement by a high energy liquid stream, since the fiber itself is highly elastic and excessively flexible. It is thus impossible to prepare, by such conventional methods, a fibrous mat suited for use as a substrate for artificial leather, namely a fibrous mat having sufficient strength, a feeling indicative of firmness, and good elasticity or stretchability, and sufficient degree of fiber entanglement.

In Japanese patent application Kokai No. Sho-48-18,579, for instance, there is disclosed, as a fibrous mat having elasticity and strength, a fibrous mat produced by blending 5–80 weight percent of an elastic fiber with a nonelastic fiber. Since the elastic fiber and nonelastic fiber are significantly different in stiffness and elasticity, however, it is very difficult to attain sufficient blending of such fibers, or obtain a desired web on a card machine, or achieve a sufficient extent of entanglement. In fact, according to the above disclosure, such fibrous mat is produced by dispersing an elastic fiber and a nonelastic fiber in water and forming a mat on a screen in a manner of paper making, followed by simply bonding with a binder resin. Therefore, the fibrous mat obtained by the above method is not a three-dimensionally entangled fibrous mat, so that it is inferior or unsatisfactory in resistance to repeated deformation, in fullness, and in firm-bodiedness.

In Japanese patent application Kokai No. Sho-52-85,575, there is disclosed a method comprising making an entangled fibrous mat using a composite fiber made of a nonelastic polymer and an elastic polymer and then separating the component polymers from each other. However, a structure capable of affording a sufficient degree of elasticity cannot be produced by this method since the elastic polymer and nonelastic polymer are constrained both in the same condition. In Japanese patent publication No. Sho-40-2,792, a further method is disclosed which comprises forming a blend of a mix-spun fiber made of an elastic polymer and a nonelastic polymer with a mix-spun fiber made of nonelastic polymers into a fibrous mat, dissolving at least one of the nonelastic polymers in the fibers constituting the fibrous mat, and causing the nonelastic polymer to coagulate again within the fibrous mat. This method produces a fibrous mat having a sufficient extent of entanglement for use as a substrate for leather-like sheet materials. However, since the elasticity of this fibrous mat depends on the nonelastic polymer fiber, the mat exhibits insufficient elasticity. Thus, stretching of this mat by force will result in disengagement of entangled fibers from one another, leading to destruction of the mat structure. To sum up, the known methods to date have failed to provide an entangled fibrous mat which is satisfactory in both entangledness and elasticity.

SUMMARY OF THE INVENTION

An object of the present invention is to provide a fibrous mat superior in fiber entanglement and showing elasticity such that structural destruction does not take place upon repeated deformation. A further object is to provide a fibrous mat which is very flexible, rich in fullness, and firm-bodied and, accordingly, is very suited for use as a substrate for leather-like sheet materials.

These objects can be accomplished by providing an entangled fibrous mat comprising a fiber principally made of an elastic polymer (hereinafter called "fiber A") and a fiber principally made of a nonelastic polymer (hereinafter "fiber B"), in which mat, said fiber A has voids therein and is in a taut condition, while said fiber B is in a slack condition.

Such fibrous mat can be obtained by blending a fiber made of an elastic polymer and a nonelastic polymer (hereinafter, "fiber C") and a fiber made of a nonelastic polymer (hereinafter, "fiber D"), forming a web from the fiber blend, subjecting the web to treatment for entanglemenet, and subjecting the resulting fibrous mat to the following steps (1) and (2) in the order of (1)–(2) or (2)–(1):

(1) the step of subjecting the fibrous mat to shrinkage under conditions such that the elastic polymer-containing fiber shrinks to a greater extent as compared with the elastic polymer-free fiber;

(2) the step of removing the nonelastic polymer from said fiber C.

The fibrous mat according to the invention may be impregnated with a binder resin. The binder resin performs the function of bonding the mat-constituting fibers at places. Therefore, when impregnated with a binder resin, the fibrous mat becomes more resistant to structural deformation upon repeated stretching or the like and at the same time becomes rich in fullness.

BRIEF DESCRIPTION OF THE DRAWINGS

The fibrous mat according to the invention is described referring to the accompanying drawings.

In FIG. 1, 1 is an elastic polymer fiber which is in a nearly taut condition while 2 is a nonelastic polymer fiber in a slack condition.

In FIG. 2, 1 and 2 respectively indicate the same fibers as in FIG. 1, 3 is the point of bonding by means of the binder resin, and 4 is the point of fixation brought about by entanglement. Even without binder resin impregnation, the fibrous mat according to the invention contains places of fiber bonding or fixation as a result of elastic polymer fiber-to-elastic polymer fiber agglutination and/or elastic polymer fiber-to-other fiber agglutination caused by the heat treatment in the above step (1) or by the treatment for nonelastic polymer removal in the above step (2). Therefore, the mat undergoes little structural deformation when exposed to repeated stretching or the like deformation. In FIG. 1, 5 indicates the point of elastic polymer fiber-to-elastic polymer fiber bonding as a result of agglutination, and 6 indicates the point of fixation resulting from fiber entanglement within the mat.

DETAILED DESCRIPTION OF THE PREFERRED EMBODIMENTS

Figure 1:
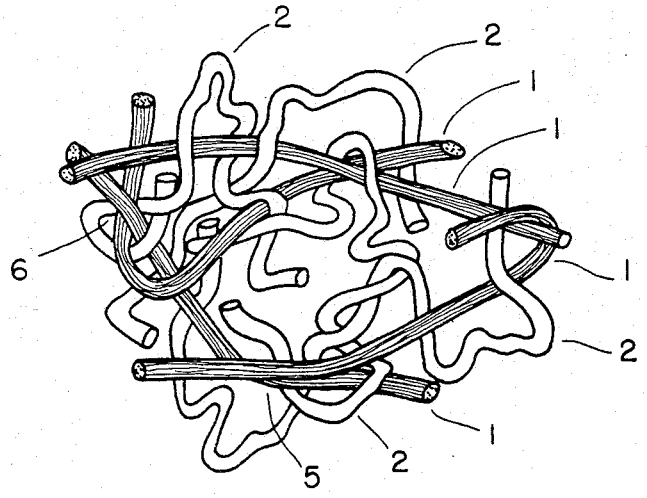
FIG. 1 is a schematic representation of an entangled fibrous mat according to the invention.
Figure 2:
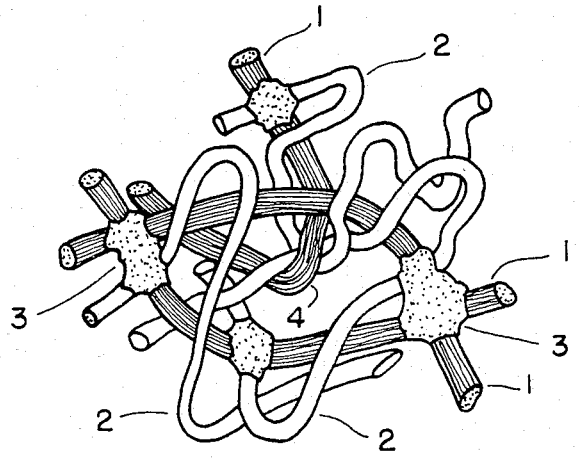
FIG. 2 is a schematic representation of an entangled fibrous mat according to the invention which is impregnated with a binder resin.

The fibrous mat according to the invention and the production thereof are described hereinbelow in more detail.

As the materials for forming the highly elastic entangled fibrous mat according to the invention, there are used a fiber C made of an elastic polymer and a nonelastic polymer incompatible with said elastic polymer and a fiber D made of a nonelastic polymer. The use of such fiber C in which an elastic polymer and a nonelastic polymer coexist without showing compatibility allows the elongation behavior and stiffness, among others, of the fiber C to become very near to those of the fiber D made of a nonelastic polymer. As a result, both the fibers show good blendability and a well entangled condition can be attained by needle punching or by use of a high energy liquid stream.

The term "elastic polymer" as used herein signifies a polymer which provides a fiber exhibiting an elastic recovery, as measured one minute after 50% elongation at room temperature, of not less than 90%, whereas, the term "nonelastic polymer" signifies a polymer which provides a fiber exhibiting an elastic recovery of not more than 50% as measured in the same manner as above or a fiber having a percentage elongation of less than 50% at room temperature.

The fiber C-constituting elastic polymer to be used in the practice of the present invention includes, among others, a polyurethane produced by reacting at least one polymer diol having an average molecular weight of 500–3,500 and selected from the group consisting of polyester diols, polyether diols, polyester-ether diols, polycarbonate diols and other polymer diols with an organic diisocyanate in the presence of a chain extender containing two active hydrogen atoms, a conjugated diene polymer or a conjugated diene polymer block-containing polymer, such as polyisoprene or polybutadiene, and polymers which are spinnable and show the above-mentioned rubber-like elasticity.

The fiber C-constituting nonelastic polymer includes those polymers which show the above-mentioned stretchability and are soluble in a solvent. Examples of the nonelastic polymer are a polyolefin or olefin copolymer, such as polyethylene, polypropylene or polybutylene, polystyrene or a styrene copolymer, polyvinyl chloride or a vinyl chloride copolymer, a polyester and polycarbonate.

The combination of the elastic polymer and nonelastic polymer is selected from among the combinations in which the elastic polymer and nonelastic polymer differ in solubility in a specific solvent, in a manner, for example, such that their thermal molding temperature ranges are overlapping or that they are soluble in a common solvent or respectively soluble in solvents miscible with each other but do not react or interact with each other in the dissolved state within the time period required for spinning or, in other words, do not disturb the step of spinning. Examples of the combination are polyurethane-polyolefin, polyurethane-polystyrene, polyurethane-mixture of polyolefin and polystyrene, conjugated diene polymer-polystyrene, and conjugated diene polymer-polyester. The percentage of the elastic polymer in fiber C is 30–80% by weight, preferably 40–70% by weight.

The fiber C can be produced from these polymers by wet spinning, dry spinning, or melt spinning, preferably by melt spinning or dry spinning. Thus, for instance, the fiber C can be obtained by melting or dissolving the elastic polymer and nonelastic polymer in one and the same melting or dissolution system, followed by spinning, or by melting or dissolving the elastic polymer and nonelastic polymer in different melting or dissolution systems and combining the streams of the melts or solutions at the spinning head or spinneret so as to form a mixed stream for spinning. As necessary, the fiber C is drawn under dry heated, wet heated, or hot water conditions. The fiber may further be subjected to a necessary treatment, such as crimping or chopping to an appropriate length, preferably a length of 20–100 mm. The thus-produced fiber does not have the elongation behavior, elastic recovery property and flexibility which are characteristic of an elastic fiber, since the elastic polymer and nonelastic polymer coexist in the polymer in an integrated condition so as to restrict the behavior of the fiber as an elastic fiber.

The fiber D-constituting nonelastic polymer to be used in the practice of the invention includes, among others, a spinnable polyester, such as polyethylene terephthalate or a copolymer for the most part consisting thereof, polybutylene terephthalate or a copolymer for the most part consisting thereof, an aliphatic polyester, or a copolymer thereof; a nylon, typically nylon-6, nylon-66, nylon-610 or nylon-12, and other spinnable polyamides; a polyolefin, such as polyethylene, polypropylene or polybutylene: an acrylic copolymer; and polyvinyl alcohol. A regenerated fiber, such as rayon, a semisynthetic fiber, such as cellulose acetate, and a natural fiber, such as silk, flax or wool, may also be used as the fiber D.

When, in practicing the invention, a fiber composed of at least two nonelastic fibers is used as the fiber D and at least one nonelastic polymer is removed from the fiber D at an appropriate step in the course of the entangled fibrous mat production so as to leave at least one nonelastic polymer, the resulting entangled fibrous mat will have much more improved elasticity and flexibility. Suitable nonelastic polymers for constituting fiber D are, for example, those synthetic nonelastic polymers mentioned above, polystyrene, a styrene copolymer, polyvinyl chloride, and other polymers which are spinnable in the presence of a spinnable polymer. For producing the fiber composed of at least two nonelastic polymers, a combination of two or more polymers is selected from among nonelastic polymers such as mentioned above in a manner such that the polymers selected differ in solubility in a specific solvent and that the thermal molding temperature ranges therefor are overlapping or the polymers are soluble in a common solvent or solvents miscible with each other. Said fiber can be produced from the thus-selected combination of polymers by wet spinning, dry spinning, or melt spinning. Typical examples of the polymer combination are polyethylene terephthalate-polyethylene, nylon-6-polyethylene, nylon-6-polystyrene, polyethylene terephthalate-polystyrene, polypropylene-polystyrene, and nylon-6-polyvinyl alcohol. The nonelastic polymer fiber B or D may contain an elastic polymer or the like if the fiber B or D shows a much smaller shrinkage as compared with the elastic polymer-containing fiber (namely fiber A or C) in the step (1) to be described later in more detail.

A fiber made of at least two polymers for use as fiber D can be produced, for instance, by melting or dissolving the polymers in one and the same melting or dissolution system followed by spinning, or by melting or dissolving the polymers in different melting or dissolution systems and combining the streams of the resulting melts or solutions at the spinning head or spinneret so as to form a mixed stream for spinning. The fiber D is generally drawn, crimped and chopped to a staple length in the conventional manner.

The fibers C and D are then blended. The preferred blending ratio depends on whether the fiber D is subjected later to a treatment for removal of at least one polymer constituting the same. In cases where at least one polymer is to be removed later from the fiber D, the blending ratio between fiber C and fiber D is preferably such that the fiber C amounts to 15–85% by weight, more preferably 25–70% by weight, whereas, in cases where the fiber D is not subjected to such treatment, the ratio is preferably such that the fiber C amounts to 20–90% by weight, more preferably 35–85% by weight. A blend of two or more fibers each made of an elastic polymer and a nonelastic polymer may be used as the fiber C. Furthermore, a blend of two or more fibers each made of a nonelastic polymer or a blend of one or more fibers each made of two or more nonelastic polymers may also be used as the fiber D.

After blending in an appropriate ratio, the fiber C and fiber D are opened on a card and then formed into a random web or cross-laid web on a webber. As necessary, the weight of the web is increased to a desired level by laying another sheet or sheets of web thereon. The additional sheet or sheets of web may be of a web differing in the fiber blending ratio. The web weight is preferably in the range of 100–3,000 g/m$^2$ although it depends on the intended use of the product.

The web is then subjected to treatment for entanglement by a known technique, to give an entangled fibrous mat. A preferred treatment for entanglement is needle punching. While the needle punching conditions, such as the punch density, which are preferred depend on the needle shape and web thickness, a punch density of 200–2,500 punches/cm$^2$ is generally employed. If the needle punching conditions are too severe, the effect of causing fiber breakage surpasses the effect of causing fiber entanglement and causes structural destruction and increase in web area, whereby the elasticity is unfavorably affected. On the other hand, insufficient entanglement will result in failure to provide a sufficient degree of elasticity.

For rendering the entangled fibrous mat according to the invention satisfactory in elasticity behavior, shrinkage of the entangled fibrous mat is required. The extent of shrinkage is such that the reduction in mat area amounts to 10–80% on the pretreatment basis. Such shrinkage should be conducted so that the elastic polymer-containing fiber shrinks to a greater extent as compared with the elastic polymer-free fiber. Generally, an elastic polymer tends to shrink at lower temperatures as compared with a nonelastic polymer. Therefore, in the practice of the invention, the shrinkage treatment is preferably carried out under temperature conditions such that the elastic polymer-containing fiber shrinks while the elastic polymer--free fiber does not shrink substantially or shrinks only to a far smaller extent as compared with the elastic polymer-containing fiber.

As a result of such shrinkage treatment, the elastic polymer fiber A is in a shrunken state in the finally-obtained, entangled fibrous mat and, on the other hand, the nonelastic polymer fiber B (fiber B being the same as fiber D when a fiber made of a single polymer is used as a fiber D or when a fiber made of two or more polymers is used as fiber D without any subsequent treatment for removing one polymer therefrom) either remains unshrunken or is in an only slightly shrunken state as compared with said fiber A, so that the fiber A is in a taut condition in the entangled fibrous mat while the fiber B is in a slack condition.

Because of such fiber conditions within the entangled fibrous mat, a stretching force on the engtangled fibrous mat will be resisted exclusively by the elongation of fiber A and, as far as the extent of elongation is within the range in which the fiber B changes its conditions from slack to taut, no substantial structural destruction of the entangled fibrous mat takes place, that is, there never occurs a state in which the interfibrous fixation brought about by entanglement, by agglutination of elastic fiber, or by a binder resin is undone. Therefore, the entangled fibrous mat is substantially resistant to structural deformation even upon repeated action of a stretching force.

As will be evident from the above description, the elasticity of the entangled fibrous mat according to the invention is very closely related to the rate of shrinkage of the entangled fibrous mat in the step of shrinkage. Thus, for instance, a high percentage of shrinkage increases the possible range of elongation of the entangled fibrous mat.

While the rate of shrinkage of the entangled fibrous mat may also be adjusted by varying the shrinkage treatment conditions (temperature, time, tension, etc.), the potential shrinkability (maximum shrinkage) of the entangled fibrous mat is determined for the most part by the potential shrinkability of fiber C which depends on the kind of elastic polymer, composition of fiber C, spinning conditions and rate of drawing, among others, and by the flexural stiffness of fiber D, which pricipally depends on the kind of nonelastic polymer and fineness of fiber D, as well as by the fiber blending ratio. Accordingly, the rate of shrinkage of the entangled fibrous mat can be varied in an arbitrary manner by varying the above factors.

The step of subjecting the entangled fibrous mat to shrinkage may be conducted by any of (1) the method of causing shrinkage in the state of an entangled fibrous mat as it is, (2) the method of causing shrinkage, following impregnation with a binder resin, either in the step of coagulation of said resin or after coagulation, and (3) the method of causing shrinkage either simultaneously in the step of removing at least one polymer from fiber C or D or thereafter, or by a combination of these methods, in each case in a manner such that the desired extent of area reduction can finally be attained. The shrinkage is effected by wet or dry heat treatment, optionally with the combined use of a chemical agent incapable of impairing the remaining fiber components. The shrinkage treatment adds, in addition to the original rubber-like elasticity of fiber A, an elasticity or compression resiliency attributable to the structure of the entangled fibrous mat to said fibrous mat, whereby the simple rubber-like elasticity is controlled and the fibrous mat acquires flexibility with a feeling of firm-bodiedness.

In accordance with the invention, it is necessary to remove the nonelastic polymer from the fiber C constituting the entangled fibrous mat. In cases where the fiber D is made of two or more nonelastic polymers, as mentioned hereinabove, the elasticity and flexibility can be still more improved by removing at least one nonelastic polymer therefrom so as to leave at least one nonelastic polymer. The polymer removal may be achieved by dissolution with a solvent for the polymer to be removed, by decomposition with a decomposing agent, or by any other appropriate method. In cases where a binder resin is present, the solvent or decomposing agent is required to be substantially incapable of dissolving or decomposing the binder resin.

The fibers A and B obtained by removing at least one polymer therefrom so as to leave at least one polymer, each have the form of a fine-denier fiber bundle, or the form of a fiber with a number of voids arranged along the fiber axis, or a combination of these forms, for instance. In cases where the elastic polymer fiber has the form of a fine-denier fiber bundle, the fine-denier fibers agglutinate with one another during the subsequent treatment step or steps or with the lapse of time, to form something like a single fiber with long voids contained therein along the fiber axis. Therefore, every elastic polymer eventually assumes the form of a fiber with long voids present therein along the fiber axis. When the fiber B is in the form of a fine-denier fiber bundle, the fine-denier fibers each may be either continuous or discontinuous but of a length sufficient to meet the requirements set forth from the strength-of-product viewpoint. The fibers may have either a circular cross section or an irregular or modified cross section.

The step of removing at least one component from each of the fibers C and D so as to leave at least one component is not always required to be conducted for both the fibers C and D simultaneously. Thus, the nonelastic polymer may first be removed from the fiber C and then at least one component may be removed from the fiber D; the order may be reversed. On account of simplicity of the step, however, it is preferable to remove the nonelastic polymer from the fiber C and at least one component from the fiber D at the same time by using a common solvent or a common decomposing agent.

It is preferred that not only the elastic polymer fiber A but also the nonelastic polymer fiber B, which is one of the constituents of the entangled fibrous mat according to the invention, is the so-called modified fiber produced by removing at least one component from a precursor fiber, because, in that case, an entangled fibrous mat which is very flexible and highly stretchable or elastic can be obtained.

As mentioned hereinabove the fibrous mat according to the invention may be provided with a binder resin. The binder resin to be used may be an elastic polymer or a nonelastic polymer, or a polymer intermediate therebetween. However, for producing a highly flexible and highly elastic fibrous mat, the use of an elastic polymer is preferred. Examples of the elastic polymer usable as the binder resin are polyurethanes, such as polyester-based polyurethanes, polyether-based polyurethanes, polyester-ether-based polyurethanes and polycarbonate-based polyurethanes, acrylic acid and acrylate ester polymers, conjugated diene polymers, such as polyisoprene and polybutadiene, conjugated diene polymer block-containing polymers, styrene-butadiene copolymers, acrylonitrile-butadiene copolymers, and vinyl acetate polymer and copolymers. When the use of a resin having less elasticity as the binder resin is desired, plasticized vinyl chloride polymer and copolymers, polyamides, modified polyamides, ethylene-vinyl acetate copolymer, and the like polymers may also be used. One or two (or more) polymers selected from among the above polymers are dissolved or dispersed in a solvent or dispersion medium which will not dissolve or swell the fibrous mat-constituting fibers to a significant extent, and the fibrous mat is immersed within the solution or dispersion.

The immersion of the entangled fibrous mat with the binder resin solution or dispersion may be conducted in any of the orders: (1) immersion of the entangled fibrous mat therein before shrinkage (2) immersion of the entangled fibrous mat therein after shrinkage treatment, and (3) immersion of the entangled fibrous mat therein after removal of at least one polymer from the fiber C or D. For obtaining an entangled fibrous mat characterized by the three features, namely elasticity, flexibility and firm-bodied feeling, it is preferable to provide the mat with a binder resin in the order (1) or (2). For obtaining an entangled fibrous mat characterized by the features elasticity and resiliency, the provision of a binder resin in the order (3) is preferred.

The coagulation of the binder resin on the entangled fibrous mat immersed within the binder resin solution or dispersion can be effected, for example, by heat treatment, hot water treatment, treatment in an aqueous salt solution, or treatment in a nonsolvent for the binder resin or in a mixture of a solvent and a nonsolvent. Any appropriate coagulation method can be employed depending on the characteristic properties of the binder resin and further on the feeling and physical properties desired of the fibrous mat. The provision of the binder resin makes the fibrous mat more resistant to structural destruction upon repeated elongation deformation and at the same time richer in fullness, and accordingly very suited for use as a substrate for leather-like sheet materials.

The fibrous mat produced in accordance with the invention may, as necessary, be sliced to a desired thickness. The mat may also be sliced into a plurality of fibrous mats having a certain specific thickness. The fibrous mat is processed into a leather-like sheet material by surface treatment for buffing or napping, for example by means of a sandpaper, or for smoothening, for example by ironing, or by treatment for face-making or coloration by coating with some other polymer, and/or for embossing, whereby the mat surface assumes the appearance of a napped face, a smooth face or a grain. If necessary for the production of a leather-like sheet material product, the fibrous mat further may be subjected to treatment with a softening agent, staking, dyeing, treatment with a fire retardant, treatment with a water repellent or a waterproofing agent, and/or treatment with a weather and light stabilizer, amongst others.

The ratio of the elastic polymer fiber A to the nonelastic polymer fiber B in the fibrous mat according to the invention is preferably within the range of 85:15 to 15:85 on a weight basis. In case the proportion of fiber A exceeds 85% by weight, the fullness and firm-bodiedness are lost and the resistance to elongation deformation is decreased. If the proportion of fiber A is below 15% by weight, the product fibrous mat will be inferior in elasticity. A particularly preferred fiber A-to-fiber B weight ratio is in the range of 70:30 to 20:80.

Since the elastic polymer fiber A is a modified fiber, the fibrous mat according to the invention feels a little rubber-like and is rich in flexibility. Furthermore, since even the elastic polymer fiber is in the state of relatively good fiber blending within the entangled fibrous mat or forms a uniform layer therewithin, the behavior of the fibrous mat toward stretching is without conspicuous lack in uniformity in elongation. In addition, the fibrous mat according to the invention has an inside structure such that the points of interfibrous crossing and contact within the entangled fibrous mat, at least in part, are fixed by agglutination of the elastic polymer fiber and/or by means of the binder resin, with the fiber A being in a taut condition among the points of fixation by the binder resin or by agglutination or by entanglement while the fiber B is in a slack condition.

Based on such structure, the elongation of the mat takes place in the following manner. First, the nonelastic fiber undergoes structural stretching deformation (i.e. transfer from the slack condition to a taut condition), while the elastic fiber undergoes elongation deformation (i.e. tensile elongation of the fiber itself). Then, when the nonelastic fiber has attained the taut condition, the elongation deformation of the nonelastic fiber adds to the elongation deformation of the elastic fiber itself, whereupon the stress in response to the elongation rises abruptly. Thus, while the elongation of the mat is within a range (generally 15–50%) such that no substantial elongation deformation of the nonelastic fiber itself takes place, the stress is very small and the mat shows a very good elasticity but, for achieving a greater elongation deformation of the mat, a great stress is required for the elongation deformation because of the effect of entanglement of the nonelastic fiber. Therefore, the fibrous mat according to the invention hardly undergoes structural destruction upon repeated elongation deformation but retains good elasticity if the elongation is within a range (e.g. about 30% elongation deformation) such that substantially no elongation deformation of the nonelastic fiber takes place.

Since it is superior in elasticity and has flexibility, the fibrous mat according to the invention, when processed so as to assume a napped face, a smooth face or a grain at least on one side thereof, can be used as a leather-like sheet material for producing clothing, in particular sportswear, and shoes, and further other body supporters, bands and articles for medical use. The mat thus has a very wide range of utility.

The following examples, which are by no means limitative of the invention, will illustrate the invention in more detail. In the examples, "part(s)" and "%" are on a weight basis. The elastic recovery data given for the fibers used in the examples are the data obtained by the method of measurement as described hereinbefore.

EXAMPLES 1–4 and COMPARATIVE EXAMPLES 1 & 2

A two-component fiber was prepared by melt spinning from 60 parts of polyester-based polyurethane (elastic recovery after elongation = 100%) and 40 parts of low density polyethylene (incapable of being elongated by 50%), with the polyethylene as the nonelastic polymer. The fiber was drawn 2.8-fold, crimped, and chopped to a fiber length of 51 mm to give a staple fiber (hereinafter, "fiber $C_1$") having a fineness of 6 denier. Separately, a two-component fiber was prepared by melt spinning from 50 parts of nylon-6 (elastic recovery after elongation 50%) and 50 parts of low density polyethylene, then drawn, heat-treated, crimped, and chopped to a fiber length of 51 mm, to give a staple (hereinafter, "fiber $D_1$") having a fineness of 4 denier.

The fiber $C_1$ and fiber $D_1$ were blended in the proportion given in Table 1, opened on a card machine, and formed into a random web on a random webber. The web was needle-punched alternately from both sides thereof with No. 40 needles at a total punch density of 560 punches/cm$^2$. The thus-obtained entangled fibrous mat weighing about 400 g/m$^2$ was placed on a Teflon-coated sheet, and treated in a slack condition in hot air at 135° C., causing shrinkage of the entangled fibrous mat.

The entangled fibrous mat after shrinkage treatment was subjected to treatment for removal of the polyethylene by repeated immersion in hot perchloroethylene at about 80° C., each time followed by squeezing, then air-dried for removing the solvent, and subjected to drying heat treatment in hot air at about 130° C., whereupon adhesion by agglutination occurred at places of contact among pieces of the polyurethane fiber. The thus-obtained entangled fibrous mat contained the polyurethane fiber and nylon-6 fiber in a good blending state. The fiber formed after removal of the polyethylene was flexible, and there were a large number of knots resulting from entanglement. The fibrous mat thus had good elasticity and did not undergo structural deformation even upon 30% elongation. The condition of the entangled fibrous mat obtained in each example is shown in Table 1.

Each entangled fibrous mat according to the invention was flexible and lacking or poor in the fibrous feeling characteristic of usual entangled fibrous mats. The relatively thick specimens obtained in Examples 1 and 2, when ironed for smoothing the surface, followed by coloration, become materials usable in the production of casual shoes. When reduced in thickness, they become materials usable as supporters. The specimens obtained in Examples 3 and 4, when surface-treated for napping, give suede-like materials.

TABLE 1

| Example No. | Fiber blending ratio (%) Fiber $C_1$ | Fiber $D_1$ | Shrinkage (%) | Weight after shrinkage (g/m$^2$) | After extraction: Apparent specific gravity | After extraction: State |
|---|---|---|---|---|---|---|
| 1 | 75 | 25 | 80 | 2,000 | 0.45 | Rich in fullness, highly elastic |
| 2 | 65 | 35 | 70 | 1,330 | 0.42 | Rich in fullness, highly elastic |
| 3 | 50 | 50 | 53 | 930 | 0.39 | Flexible, rich in drapability, good |

TABLE 1-continued

| Example No. | Fiber blending ratio (%) Fiber $C_1$ | Fiber $D_1$ | Shrinkage (%) | Weight after shrinkage ($g/m^2$) | After extraction Apparent specific gravity | State |
|---|---|---|---|---|---|---|
| | | | | | | in elasticity |
| 4 | 30 | 70 | 29 | 560 | 0.34 | Flexible and elastic |
| Comparative 1 | 10 | 90 | 8 | 435 | 0.30 | Flexible, but low in elastic recovery after elongation |
| Comparative 2 | 0 | 100 | 2 | 410 | 0.27 | Flexible, but structural deformation at 30% elongation |

Observation, through magnification, of the entangled fibrous mats obtained in the above examples revealed that the polyurethane fiber was in a taut condition while the nylon-6 fiber was in a slack condition. This was not the case with the entangled fibrous mats obtained in the comprative examples. The polyurethane fiber contained therein long voids lengthwise along the fiber axis.

EXAMPLES 5–7 & COMPARATIVE EXAMPLE 3

A two-component fiber was produced by melt spinning from 60 parts of a polyester-based polyurethane (elastic recovery after elongation = 100%) and 40 parts of a modified polystyrene (incapable of being elongated by 50%), drawn 2.5-fold, crimped, and chopped to a fiber length of 51 mm. There was thus obtained a staple fiber having a fineness of 6 denier (hereinafter, "fiber $C_2$"). Another two-component fiber was produced by melt spinning from 50 parts of polyethylene terephthalate (elastic recovery after elongation < 50%) and 50 parts of low density polyethylene, with the polyethylene as the nonelastic component, then drawn, heat-treated, crimped, and chopped to a fiber length of 51 mm. There was thus obtained a nonshrinking staple having a fineness of 4 denier (hereinafter, "fiber $D_2$").

The fiber $C_2$ and fiber $D_2$ were blended in the proportion given in Table 2, opened on a card, and formed into a cross laid web. The web was needle-punched alternately from both sides thereof with No. 40 needles to a total punch density of 700 punches/$cm^2$. The thus-produced entangled fibrous mat, which weighed about 750 $g/m^2$, was introduced, in a slack state, into perchloroethylene at about 85° C. so as to eliminate the polystyrene and polyethylene in the fibers by dissolution and at the same time cause shrinkage. The solvent was removed by squeezing and, then, the web was pressed and dried in a hot air stream at about 80° C. The entangled fibrous mat thus obtained contained points of adhesion formed by agglutination, at places of contact among pieces of the polyurethane fiber. The polyurethane fiber and polyethylene terephthalate fiber were flexible and in a satisfactorily blended state and, as a result, contained a large number of knots resulting from entanglement of fiber pieces. Consequently, the mat showed a good elasticity and was resistant to structural deformation even at 30% elongation. The state of each entangled fibrous mat obtained is shown in Table 2.

TABLE 2

| Example No. | Fiber blending ratio (%) Fiber $C_2$ | Fiber $D_2$ | Shrinkage (%) | After extraction Apparent specific gravity | State |
|---|---|---|---|---|---|
| 5 | 70 | 30 | 65 | 0.45 | Rich in fullness, highly elastic |
| 6 | 50 | 50 | 48 | 0.41 | Flexible, rich in drapability, good in elasticity |
| 7 | 30 | 70 | 30 | 0.36 | Flexible and elastic |
| Comparative 3 | 0 | 100 | 2.5 | 0.28 | Flexible, but structural deformation at 30% elongation |

Observation, through magnification, of the entangled fibrous mats obtained in the examples and of the polyurethane fiber inside gave findings similar to those mentioned hereinabove for Examples 1–4.

EXAMPLES 8–11 & COMPARATIVE EXAMPLES 4–5

A two-component fiber consisting of 55 parts of a polyester-based polyurethane and 45 parts of low density polyethylene was produced by melt spinning. The fiber was drawn 2.5-fold, crimped, and chopped to give a staple, 6 denier in fineness and 51 mm in fiber length (hereinafter, "fiber $C_3$"). Separately, nylon-6 was melt-spun into a fiber, which was drawn, heat-treated for fixation, crimped, and chopped to give a staple, 2 denier in fineness and 51 mm in fiber length. The fiber $C_3$ and the above nylon fiber were blended in the proportion specified in Table 3, opened on a card, and formed into a web on a random webber. The web was subjected to needle punching with No. 40 needles alternatingly from both sides thereof to a total punch density of 700 punches/$cm^2$. The thus-produced entangled fibrous mat, which weighed about 400 $g/m^2$, was placed on a Teflon-coated sheet and treated, in a substantially slack condition, in hot air at 135° C. for causing shrinkage of the entangled fibrous mat.

The entangled fibrous mat after shrinkage was subjected to repeated immersion in hot toluene at about 80° C., each time followed by squeezing. After removal of the polyethylene by dissolution in that manner, the mat was dried in hot air at about 80° C., and pressed while still under heating. In the entangled fibrous mat obtained, the polyurethane fiber and nylon-6 fiber were in a satisfactorily blended state, with the points of contact among polyurethane fiber pieces forming points of adhesion resulting from agglutination. The mat had good elasticity and was resistant to structural deformation even at 30% elongation. Observation, through magnification, of the inside of the entangled fibrous mat obtained in each of these examples and comparative examples and of the inside of the polyurethane fiber gave the same findings as those mentioned hereinabove for Examples 1–4 and Comparative Examples 1–2, respectively.

TABLE 3

| Example No. | Fiber blending ratio (%) Fiber $C_3$ | Nylon-6 fiber | Shrinkage (%) | Weight after shrinkage (g/m²) | After extraction Apparent specific gravity | State |
|---|---|---|---|---|---|---|
| 8 | 80 | 20 | 65 | 1,140 | 0.28 | Rich in fullness, highly flexible, good in drapability |
| 9 | 65 | 35 | 50 | 800 | 0.20 | Flexible, good in drapability and elesticity |
| 10 | 50 | 50 | 31 | 580 | 0.14 | Bulky and elastic |
| 11 | 30 | 70 | 14 | 465 | 0.12 | Bulky and elastic |
| Comparative 4 | 10 | 90 | 4 | 417 | 0.10 | Structural deformation at 30% elongation, low in elastic recovery after elongation |
| Comparative 5 | 0 | 100 | 1.5 | 405 | 0.10 | Structural deformation at 30% elongation |

The entangled fibrous mats according to the invention were flexible, and elastic, but poor or lacking in the fibrous feeling characteristic of usual entangled fibrous mats. On the other hand, the entangled fibrous mats obtained in the comparative examples underwent structural deformation at 30% elongation and were low in elastic recovery.

EXAMPLES 12–14 & COMPARATIVE EXAMPLES 6–7

A three-component fiber was produced by melt spinning from 50 parts of a polyester-based polyurethane, 35 parts of polystyrene (incapable of being elongated by 50%) and 15 parts of low density polyethylene, drawn 3-fold, crimped, and chopped to give a staple, 6 denier in fineness and 51 mm in fiber length (hereinafter, "fiber $C_4$). In addition, a 1.5-denier staple of nonshrinking polyethylene terephthalate (PET fiber) was used. The fiber $C_4$ and this poylethylene terephtalate fiber were blended in the proportion specified in Table 4, opened on a card, and formed into a cross laid web. The web was subjected to needle punching with No. 40 needles alternatingly from both sides thereof to a total punch density of 560 punches/cm². The resulting entangled fibrous mat weighing about 650 g/m² was subjected to immersion-squeezing treatment with perchloroethylene at about 80° C., whereby the polystyrene and polyethylene in the fibers were removed by dissolution. The mat was dried in hot air at about 80° C. At an early stage of drying, the entangled fibrous mat after extraction was pressed, so that points of adhesion brought about by agglutination were formed at places of contact among the polyurethane fiber pieces. The entangled fibrous mat underwent shrinkage during the steps of solvent treatment and drying. The polyurethane fiber had a good state of fiber blending and was resistant to structural deformation even at 30% elongation. The findings obtained by observation, through manification, of the entangled fibrous mat obtained in each of the examples and comparative examples and of the polyurethane fiber inside were the same as those mentioned in the preceding examples or comparative examples, respectively.

The state of each entangled fibrous mat obtained is shown in Table 4.

TABLE 4

| Example No. | Fiber blending ratio (%) Fiber $C_2$ | PET fiber | Shrinkage (%) | After extraction Apparent specific gravity | State |
|---|---|---|---|---|---|
| 12 | 80 | 20 | 70 | 0.36 | Rich in elasticity, highly elastic, good in drapability |
| 13 | 50 | 50 | 35 | 0.25 | Flexible, good in elasticity |
| 14 | 30 | 70 | 15 | 0.17 | Bulky and elastic |
| Comparative 6 | 10 | 90 | 5.5 | 0.15 | Structural deformation at 30% elongation, low in elastic recovery |
| Comparative 7 | 0 | 100 | 2.0 | 0.13 | Structural deformation at 30% elongation |

The entangled fibrous mats according to the invention were flexible, poor or lacking in the fibrous feeling characteristic of usual entangled fibrous mats, and elastic.

EXAMPLES 15–18 & COMPARATIVE EXAMPLE 8

A two-component fiber consisting of 50 parts of polyester-based polyurethane (elastic recovery after elongation = 100%) and 50 parts of low density polyethylene (incapable of being elongated by 50%), with the polyethylene as the nonelastic component, was produced by melt spinning, drawn, crimped, and chopped to give a raw stock, 6 denier in fineness and 51 mm in fiber length (hereinafter, "fiber $C_5$").

Another two-component fiber consisting of 50 parts of nylon-6 (elastic recovery after elongation < 50%) and 50 parts of the above low density polyethylene, with the polyethylene as the nonelastic component, was produced by melt spinning, drawn, crimped, and chopped to give a raw stock, 4 denier in fineness and 51 mm in fiber length (hereinafter, "fiber $D_5$").

Then, 40 parts of the fiber $C_5$ and 60 parts of the fiber $D_5$ were blended, passed through a card, and formed into a random web on a random webber. The web was needle-punched alternately from both sides thereof with No. 40 needles to a punch density of 420 punches/cm$^2$, to give an entangled fibrous mat weighing about 500 g/m$^2$. This entangled fibrous mat was immersed in an aqueous polyurethane dispersion (solids content 4%), then squeezed in a squeezing roll to a liquid content of 80%, placed on a Teflon-coated sheet, and dried in a hot air drier at a temperature of 130° C. substantially in a tensionless condition. After drying, the entangled fibrous mat showed a contraction of about 35% in the longitudinal direction as well as in the transverse direction (area reduction=about 57%).

The entangled fibrous mat was immersed in perchloroethylene at 80° C., and dried in a hot air drier at about 80° C. to dissolve out the polyethylene in fiber $C_5$ and fiber $D_5$. The sheet material obtained contained the polyurethane fiber and nylon-6 fiber in a well entangled state, weighed about 630 g/m$^2$ and showed a final area reduction of about 60%. This sheet material was sliced into two sheets approximately in the middle of the thickness with a band machine knife. The sheets were impregnated with a 5% aqueuous solution of polyvinyl alcohol and dried so as to prevent possible elongation of the sheet materials in the subsequent treatment. The sliced face was buffed with sandpaper to produce a uniform thickness. Thereafter, the original surface was provided with a 0.6 mm thick nap by buffing. The thus-obtained sheet materials were dyed with a metal complex dye (concentration 2% owf.) at a temperature of 90° C. over a period of 60 minutes, then dried, staked, and brushed to give suede-like sheet materials (Example 15). These leather-like sheet materials had a writing effect. They were high in elasticity in both the directions, very rich in flexibility, and very resistant to wrinkling.

Following the above procedure but varying the fiber blending ratio between the fiber $C_5$ and fiber $D_5$ as shown in Table 5, several suede-like sheet materials were produced. The characteristics of the sheet materials obtained are shown in Table 5. The specimens of the examples and comparative example were subjected to ten 30% elongation-recovery cycles and, after allowing to stand for 3 hours, tested for recovery rates. With the specimens of Example 15–18, the recovery rates were 99–100%, whereas the specimen of the comparative example showed a recovery of 58%.

TABLE 5

| Example No. | Fiber blending ratio (%) Fiber $C_3$ | Nylon-6 fiber | Area reduction | Apparent specific gravity | Elastic recovery after 35% elongation | Characteristics |
|---|---|---|---|---|---|---|
| 15 | 40 | 60 | 60 | 0.36 | 93 | Rich in flexibility and elasticity |
| 16 | 60 | 40 | 73 | 0.45 | 95 | Rich in fullness and elasticity |
| 17 | 80 | 20 | 80 | 0.52 | 97 | Rich in fullness and elasticity |
| 18 | 20 | 80 | 48 | 0.35 | 90 | Rich in flexibility and elasticity, and suited for use as material for clothing |
| Comparative 8 | 0 | 100 | 3 | 0.31 | 50 | Poor in elasticity |

The leather-like sheet material of Example 17 was very rich in fullness, and showed an elastic recovery of 95% even after 50% elongation. However, this sheet material was insufficient in napping to call it a suede-like sheet material. Therefore, its surface was smoothed by contacting with a flat roll surface at 120° C., then coated with a 20% aqueous polyurethane dispersion using a gravure roll and further coated with a 10% polyurethane solution using a gravure roll. The polyurethane-bearing face was embossed with a heated embossing roll. The thus-obtained grained leather-like sheet material was excellent in fullness and elasticity, and thus suited for use as a material for making the instep of shoes.

Observation, through magnification, of the inside of the leather-like sheet materials obtained in the above examples confirmed that the polyester-based polyurethane fiber was in a taut condition among the points of fixation resulting from the use of the binder resin or entanglement while the nylon-6 fiber (in the form of a bundle) was in a slack condition. Observation, through magnification, of the above polyurethane fiber revealed that it contained long voids extending therein along the fiber axis.

EXAMPLE 19

A 6-denier two-component fiber obtained by melt spinning from 60 parts of a polyester-based polyurethane (elastic recovery after elongation=100%) and 40 parts of polystyrene (incapable of being elongated by 50%) (hereinafter, "fiber $C_6$") and a 4-denier two-component fiber obtained by melt spinning from 50 parts of the low density polyethylene mentioned above and 50 parts of polyethylene terephthalate (elastic recovery after elongation<50%), with the polyethylene as the nonelastic component (hereinafter, "fiber $D_6$") were used. Thus, 30 parts of the fiber $C_6$ was blended with 70 parts of the fiber $D_6$, and a random web was made therefrom. The web was converted into an entangled fibrous mat by needle punching. Then, the polystyrene and polyethylene in the fibers were removed by dissolution in perchloroethylene at a temperature of 90° C. The fibrous mat was dried in a hot air drier at about 80° C. The entangled fibrous mat thus obtained showed an area reduction of about 30%. The entangled fibrous mat was impregnated with an about 100% amount of an aqueous dispersion of a polyurethane as the binder resin (4% solids content), placed on a Teflon-coated sheet, and dried in a hot air drier at a temperature of 130° C. in a tensionless state. The sheet material obtained was subjected to the same surface treatment, surface making and finishing as in Example 17, to give a grained leather-like sheet-material. This leather-like sheet material was rich in flexibility and elasticity, although rather high in resilience. Within this leather-like sheet material, the polyurethane fiber was in a taut condition while the polyethylene terephthalate fiber was in a slack condition, like in Examples 15–18. The inside of the polyurethane fiber was also in the same state as Examples 15–18.

COMPARATIVE EXAMPLE 9

The fiber $C_6$ obtained in Example 19 was passed through a warm water bath for preliminary free shrinkage treatment. Thereafter, following the procedure of Example 19, a random web was produced and converted into an entangled fibrous mat, the polystyrene and polyethylene were removed by dissolution, and the mat was treated in hot air and then provided with the binder resin. The thus-obtained sheet material showed that no substantial shrinkage had occurred.

The leather-like sheet material obtained from this sheet material was high in resilience but low in elasticity. At 30% elongation, it showed a recovery as small as 68% and there occurred structural destruction. Observation, through magnification, of the sheet material revealed that there was no substantial difference in the tensile condition between the polyurethane fiber and polyethylene terephthalate fiber.

EXAMPLE 20

There were used a 6-denier two-component fiber obtained by melt spinning from 40 parts of low density polyethylene and 60 parts of a polyester-based polyurethane (elastic recovery after elongation=100%) (hereinafter, "fiber $C_7$") and a 4-denier two-component fiber obtained by melt spinning from 50 parts of low density polyethylene and 50 parts of nylon-6, with the polyethylene as the nonelastic component (hereinafter, "fiber $D_7$"). Thus, 20 parts of the fiber $C_7$ was blended with 80 parts of the fiber $D_7$. A cross laid web was produced from the blend and converted into an entangled fibrous mat by needle punching. The fibrous mat was placed on a cloth and heat-treated in a hot air drier at 135° C. The thus-obtained entangled fibrous mat showed an area reduction of about 20%, had an apparent specific gravity of 0.40, and felt rather board-like and hard, with the fiber-constituting polyethylene being partly fused at points of crossing of fiber pieces. This heat-treated, entangled fibrous mat was saturated with a 10% solution of a polyether-based polyurethane in dimethylformamide. (Said solution contained 1% of water. Owing to this 1% water content, the fiber-constituting polyurethane was not attacked by the solvent dimethylformamide,and the polyurethane in the solution was not coagulated to a substantial extent, either.) The mat was then immersed in a 30% aqueous solution of dimethylformamide for causing coagulation, and then the polyethylene was removed by dissolution in toluene at a temperature of 90° C. The sheet material thus obtained was buffed with a sandpaper, and subjected to dyeing treatment, softening treatment and finishing treatment including buffing and so on, to give a suede-like sheet material.

This leather-like sheet material was excellent in napping, high in nap density, great in writing effect, and furthermore rich in flexibility, elasticity and fullness, and was thus suited for use as a material for clothing, in particular sportswear. the fibers within this leather-like sheet material as well as the polyurethane fiber inside were each in the same condition as in Example 15–18.

EXAMPLE 21 & COMPARATIVE EXAMPLE 10

The fiber $C_5$ obtained in Example 15 (100 parts) was blended with 50 parts of a 2-denier nylon-6 fiber. The blend was passed through a card and formed into a random web on a random webber. The web was needle-punched alternately from both sides thereof with No. 400 needles to a total punch density of 560 punches/cm$^2$. The thus-obtained entangled fibrous mat weighing about 450 g/m$^2$ was immersed in an aqueous dispersion of a polyurethane (4% solids content), followed by squeezing to a liquid content of about 110% using a squeezing roll. The mat was then placed on a Teflon-coated sheet, and dried in a hot air drier at a temperature of 130° C. in a substantially tensionless state. The dried entangled fibrous mat showed a contraction of about 30% in the longitudinal direction as well as in the transverse direction (area reduction=-about 50%).

The entangled fibrous mat was then immersed in perchloroethylene at 80° C. so as to remove the polyethylene in fiber C by dissolution, and dried in a hot air drier at about 80° C. The sheet material obtained weighed about 633 g/m$^2$, and the polyurethane fiber and unmodified nylon-6 fiber were well entangled therein. The sheet material was sliced into two approximately in the middle of the thickness by means of a band machine knife. Each slice was impregnated with an aqueous polyvinyl alcohol solution and dried so as to prevent possible elongation in the subsequent treatment. The sliced face was buffed with a sandpaper to provide the same with a 0.75 mm-thick nap. The sheet material was subjected to finishing treatment including dyeing and staking. The resulting napped leather-like sheet material showed high elasticity in both directions and was very rich in flexibility. The elastic recovery of this leather-like sheet material as measured after 3 hours of standing following ten 30% elongation-recovery cycles was almost 100%. Observation, through magnification, of the inside of the thus-obtained leather-like sheet material confirmed that the polyurethane fiber was in a taut condition among the points of fixation brought about by the binder resin or entanglement while the nylon-6 fiber was in a slack condition. The polyurethane fiber contained long voids lengthwise along the fiber axis.

For comparison, following the above procedure, a web was produced from a 2-denier nylon-6 fiber alone, converted into an entangled fibrous mat, and the mat was impregnated with the aqueous polyurethane dispersion and dried in a hot air drier at a temperature of 130° C. in a substantially tensionless condition. The entangled fibrous mat after drying showed an area reduction of about 8%. This sheet material was finished in the same manner. The resulting napped leather-like sheet material was poor in elasticity, the recovery as measured after 3 hours of standing following ten 30% elongation-recovery cycles being about 41%. No further recovery could be attained.

COMPARATIVE EXAMPLE 11

Using the fiber $C_5$ obtained in Example 15 in the form of a less shrinkable fiber, namely after preliminary shrinkage treatment, and following the procedure of Example 21, a random web was produced and converted into an entangled fibrous mat, the polyethylene was removed by dissolution, and the mat was impregnated with the aqueous polyurethane dispersion and dried in hot air. The thus-obtained entangled fibrous mat revealed that there had occurred no substantial shrinkage. The leather-like sheet material obtained starting with said entangled fibrous mat was poor in elasticity. At 30% elongation, the recovery was about 73% and the mat underwent structural deformation. Observation, through magnification, of the fibers in this sheet material revealed that they were in the same condition as in Comparative Example 9.

EXAMPLE 22

A two-component fiber was melt-spun from 60 parts of a polyether-based polyurethane (elastic recovery after elongation = 100%) and 40 parts of polystyrene, then drawn, crimped, and chopped to a fiber length of 51 mm, to give a two-component staple having a fineness of 6 denier. This staple fiber (50 parts) was blended with 50 parts of a 1.5-denier shrinkable polyethylene terephthalate fiber, and the blend was passed through a card and formed into a cross laid web, which was converted to an entangled fibrous mat by needle punching. The entangled fibrous mat was placed on a cloth and heat-treated by passing through a hot air drier at 135° C. An area reduction of about 65% resulted, and the entangled fibrous mat had an apparent specific gravity of 0.41. This high-density entangled fibrous mat was saturated with a 12% dimethylformamide solution of a polyester-based polyurethane (containing 2.5% of water so as to prevent coagulation of the polyurethane and prevent dissolution of the fiber-constituting polyurethane), then immersed in a 30% aqueous solution of dimethylformamide for coagulation and, further, the polystyrene was removed by dissolution in toluene at a temperature of 90° C. Both sides of the sheet material obtained were buffed with a sandpaper. Then, an aqueous polyurethane dispersion was applied to the buffed sheet material on one side thereof, followed by application, on the same side, of a colorant and polyurethane solution with a gravure roll, and embossing. The subsequent finishing treatment including dyeing, staking and brushing gave a leather-like sheet material with a grain on one side and nap on the other. This leather-like sheet material was rich in fullness, flexibility and elasticity, had an apparent specific gravity of 0.46, an elastic recovery after 35% elongation of 96%, a moisture permeability of 1,380 g/m$^2$/ day and an air permeability of 77 seconds, and was thus suited for use as a material for casual shoes. With this leather-like sheet material, the state of fibers therewithin and the state of polyurethane fiber inside were the same as in Example 21.

What is claimed is:

1. An entangled fibrous mat comprising a fiber A consisting essentially of an elastic polymer and a fiber B consisting essentially of a nonelastic polymer, said fiber A formed by removing, after entanglement with fiber B, nonelastic polymer from a fiber comprising a nonelastic polymer and an elastic polymer, thereby forming axially extending long voids therein, said fiber A being in a taut condition within the mat and said fiber B being in a slack condition.

2. A fibrous mat as claimed in claim 1, wherein said fiber B is formed by removing, from a fiber composing of at least two nonelastic polymers, at least one polymer so as to leave at least one other polymer.

3. A fibrous mat as claimed in claim 1, wherein the weight ratio of said fiber A to said fiber B is within the range of 85:15 to 15:85.

4. A fibrous mat as claimed in claim 1, wherein said fibrous mat is provided with a binder resin therein.

5. A fibrous mat as claimed in claim 1, wherein said elastic polymer is a polyurethane elastomer.

6. A fibrous mat as claimed in claim 1, wherein said nonelastic polymer comprises at least one polymer selected from the group consisting of polyesters, polyamides and polyolefins.

7. A fibrous mat as claimed in claim 4, wherein said binder resin is a polyurethane elastomer.

8. The fibrous mat as claimed in claim 1 wherein portions of said entangled fibers are generally oriented parallel to the surface of the mat and other portions are generally oriented into the thickness of the mat.

9. The fibrous mat as claimed in claim 8 wherein said fibers are entangled by needle punching.

10. A method of producing a fibrous mat having good elasticity which comprises blending a fiber C comprising an elastic polymer and nonelastic polymer and a fiber D comprising a nonelastic polymer, forming a web from the fiber blend, subjecting the web to treatment for entanglement, and subjecting the resulting fibrous mat to the following steps (1) and (2) in the order of (1)–(2) or (2)–(1):

(1) the step of subjecting the fibrous mat to shrinkage such that the elastic polymer-containing fiber shrinks to a greater extent than the substantially elastic polymer-free fiber;

(2) the step of removing the nonelastic polymer from said fiber C.

11. A method as claimed in claim 10, wherein a step (3) of impregnating the fibrous mat with a binder resin followed by coagulation is combined with the steps (1) and (2) in either of said orders.

12. A method as claimed in claim 11, wherein, when fiber D is a fiber comprising two or more nonelastic polymers, a step (4) of removing at least one polymer is combined with the steps (1)–(3) in either of said orders.

13. A method as claimed in claim 12, wherein steps (3) and (4) are carried out simultaneously.

* * * * *